US007805248B2

(12) United States Patent
Thigpen et al.

(10) Patent No.: US 7,805,248 B2
(45) Date of Patent: Sep. 28, 2010

(54) SYSTEM AND METHOD FOR WATER BREAKTHROUGH DETECTION AND INTERVENTION IN A PRODUCTION WELL

(75) Inventors: Brian L. Thigpen, Houston, TX (US); Guy P. Vachon, Houston, TX (US); Garabed Yeriazarian, Katy, TX (US); Jaedong Lee, Katy, TX (US); Chee M. Chok, Houston, TX (US); Clark Sann, Houston, TX (US); Xin Liu, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 180 days.

(21) Appl. No.: 11/737,478

(22) Filed: Apr. 19, 2007

(65) Prior Publication Data

US 2008/0262735 A1 Oct. 23, 2008

(51) Int. Cl.
*G01V 1/40* (2006.01)

(52) U.S. Cl. ..... 702/6

(58) Field of Classification Search ..... 702/6, 702/28; 436/56; 166/250.01, 339; 703/10
See application file for complete search history.

(56) References Cited

U.S. PATENT DOCUMENTS

| | | | |
|---|---|---|---|
| 3,211,225 | A | 10/1965 | Thiessen et al. |
| 3,710,867 | A | 1/1973 | Bansbach |
| 3,954,006 | A | 5/1976 | Anderson et al. |
| 3,991,827 | A | 11/1976 | Schall |
| 4,064,936 | A | 12/1977 | McClure |
| 4,284,143 | A | 8/1981 | Scherrer et al. |
| 4,354,553 | A | 10/1982 | Hensley |
| 4,375,833 | A | 3/1983 | Meadows |
| 4,436,148 | A | 3/1984 | Maxwell |
| 4,582,131 | A | 4/1986 | Plummer et al. |
| 4,589,434 | A | 5/1986 | Kelley |
| 4,635,723 | A | 1/1987 | Spivey |
| 4,665,981 | A | 5/1987 | Hayatdavoudi |
| 4,721,158 | A | 1/1988 | Merritt, Jr. et al. |
| 4,830,112 | A | 5/1989 | Erickson |

(Continued)

FOREIGN PATENT DOCUMENTS

GB 2416871 A 2/2006

(Continued)

OTHER PUBLICATIONS

Kuo, M.C. Tom., Correlations rapidly analyze water coning, Oil & Gas Journal, pp. 77-80, Midland, Tx.,1989.

(Continued)

*Primary Examiner*—Tung S Lau
*Assistant Examiner*—Xiuquin Sun
(74) *Attorney, Agent, or Firm*—Cantor Colburn LLP

(57) ABSTRACT

A system and method is provided for estimating an occurrence of a water breakthrough in a production well that includes estimating, at least periodically, a measure of water in the fluid produced from one or more production zones and estimating the occurrence of the water breakthrough utilizing at least in part a trend of the estimated measures of the produced fluid. A controller determines one or more actions to be taken to mitigate an effect of the water breakthrough and may automatically initiate one or more such actions.

21 Claims, 4 Drawing Sheets

U.S. PATENT DOCUMENTS

| | | | | |
|---|---|---|---|---|
| 4,843,247 | A | 6/1989 | Yamazoe et al. | |
| 4,901,563 | A | 2/1990 | Pearson | |
| 4,926,942 | A | 5/1990 | Profrock, Jr. | |
| 5,006,845 | A | 4/1991 | Calcar et al. | |
| 5,172,717 | A | 12/1992 | Boyle et al. | |
| 5,209,301 | A | 5/1993 | Ayres | |
| 5,305,209 | A | 4/1994 | Stein et al. | |
| 5,353,237 | A | 10/1994 | Bass et al. | |
| 5,517,593 | A | 5/1996 | Nenniger et al. | |
| 5,647,435 | A | 7/1997 | Owens et al. | |
| 5,706,896 | A | 1/1998 | Tubel et al. | |
| 5,767,680 | A | 6/1998 | Torres-Verdin | |
| 5,829,520 | A | 11/1998 | Johnson | |
| 5,937,946 | A | 8/1999 | Streetman | |
| 6,006,832 | A | 12/1999 | Tubel et al. | |
| 6,061,634 | A | 5/2000 | Belani et al. | |
| 6,070,663 | A | 6/2000 | Cernocky et al. | |
| 6,196,314 | B1 | 3/2001 | Chen | |
| 6,281,489 | B1 | 8/2001 | Tubel et al. | |
| 6,467,340 | B1 | 10/2002 | Gallagher et al. | |
| 6,543,540 | B2 | 4/2003 | Woie et al. | |
| 6,645,769 | B2 * | 11/2003 | Tayebi et al. | 436/56 |
| 6,795,773 | B2 | 9/2004 | Soliman et al. | |
| 6,851,444 | B1 | 2/2005 | Kohl et al. | |
| 6,874,361 | B1 | 4/2005 | Meltz et al. | |
| 7,434,619 | B2 | 10/2008 | Rossi et al. | |
| 7,484,563 | B2 | 2/2009 | Zazovsky et al. | |
| 7,558,715 | B2 * | 7/2009 | Schaaf et al. | 703/10 |
| 2002/0043370 | A1 | 4/2002 | Poe | |
| 2002/0179301 | A1 * | 12/2002 | Schultz et al. | 166/250.01 |
| 2003/0079912 | A1 | 5/2003 | Leuchtenberg | |
| 2004/0084180 | A1 | 5/2004 | Shah et al. | |
| 2004/0262008 | A1 * | 12/2004 | Deans et al. | 166/339 |
| 2005/0149264 | A1 | 7/2005 | Tarvin et al. | |
| 2005/0173114 | A1 | 8/2005 | Cudmore et al. | |
| 2007/0078610 | A1 * | 4/2007 | Adams et al. | 702/28 |
| 2007/0289739 | A1 | 12/2007 | Cooper et al. | |
| 2008/0201080 | A1 | 8/2008 | Lovell et al. | |

FOREIGN PATENT DOCUMENTS

| | | | |
|---|---|---|---|
| WO | WO9857030 | | 12/1998 |
| WO | WO9957417 | A | 11/1999 |
| WO | WO02063130 | A1 | 8/2002 |
| WO | WO2005045371 | A | 5/2005 |
| WO | WO2006127939 | A2 | 11/2006 |

OTHER PUBLICATIONS

Schlumberger, Well Test Interpretation, 2002, 126 pages.

* cited by examiner

SYSTEM AND METHOD FOR WATER BREAKTHROUGH DETECTION AND INTERVENTION IN A PRODUCTION WELL

BACKGROUND OF THE DISCLOSURE

1. Field of the Disclosure

This disclosure relates generally to production wells and detection and prediction of water breakthrough in such wells.

2. Background of the Art

Wellbores are drilled in subsurface formations for the production of hydrocarbons (oil and gas). After drilling of a wellbore, the wellbore is completed typically by lining the wellbore with a casing that is perforated proximate each oil and gas bearing formation (also referred to herein as the "production zone" or "reservoir") to extract the fluid from such reservoirs (referred to as the formation fluid), which typically includes water, oil and/or gas. In multiple production zone wells, packers are used to isolate the different production zones. The fluid from each production zone is channeled through one or more tubings in the well to channel the produced fluids to the surface. Sand screens are typically placed adjacent perforations to inhibit the influx of solids from the formation into the well. Valves and chokes are installed in the well to control the flow of the formation fluids into the well, from the well into the tubings in the well and through the tubings to the surface. Surface treatment units separate the hydrocarbons from the produced fluid and the separated hydrocarbons are then transported for processing via a pipeline or a mobile transportation unit.

Typically, during the early phases of production from a production zone, the formation fluid flows to the surface because the formation pressure is sufficiently greater than the pressure exerted by the fluid column in the well. This pressure differential lifts the produced fluids to the surface. As the reservoir depletes, the formation pressure is sometimes not adequate to lift the produced formation fluid to the surface. In such cases, an artificial lift mechanism is often used to lift the produced fluid from the well to the surface. An electrical submersible pump is often installed in the well to lift the formation fluid to the surface. Water or steam is sometimes injected into one or more offset wells to direct the formation fluids toward the well so as to enhance the production of the formation fluid from the reservoir. A majority of the wells typically produce hydrocarbons and a certain amount of water that is naturally present in the reservoir. However, under various conditions, such as when the reservoir has been depleted to a sufficient extent, substantial amounts of water present in adjacent formations can penetrate into the reservoir and migrate into the well. Substantial amounts of water can also enter the well due to other reasons, such as the presence of faults in the formation containing the reservoir, particularly in high porosity and high mobility formations. Faults in cement bonds between the casing and the formation, holes developed in the casing due to corrosion, etc. may also be the source of water entering the well. Excessive influx of water into the well (also referred to as the "water breakthrough") into a producing well can: be detrimental to the operation of the well; cause excessive amounts of sand flow into the well; damage downhole devices; contaminate the surface treatment facilities, etc. It is therefore desirable to have a system and methods that are useful for detecting and predicting the occurrence of a water breakthrough, determining actions that may be taken to safeguard the well and well equipment from potential damage and for taking (manually or automatically) corrective actions to reduce or eliminate potential damage to the well that may occur due to the occurrence of a water breakthrough on the well.

SUMMARY OF THE DISCLOSURE

A method of predicting an occurrence of a water breakthrough in a well that is producing fluid from one or more production zones is disclosed. In one aspect, the method includes utilizing one or more measurements relating to the presence or an amount of water in the fluid produced from a production zone to predict the occurrence of a water breakthrough. In another aspect, the method may predict an estimated time or time period of the occurrence of the water breakthrough and may send certain messages or warning signals to one or more locations, provide recommended actions that may be taken to reduce the risk of damage to the well, and may automatically initiate or take one or more actions to mitigate an effect of the water breakthrough on the well.

In another aspect, a computer-readable medium is provided that is accessible to a processor for executing instructions contained in a computer program embedded in the computer-readable medium, wherein the computer program includes instructions to at least periodically utilize a measure of water in the fluid produced by at least one production zone and one or models to predict the occurrence of a water breakthrough.

In another aspect, a system for estimating a water breakthrough is disclosed that includes a control unit that has a processor, a memory for storing a program and a database, wherein the processor using the computer program and water content measurements over time provides an estimate or prediction of water breakthrough. The processor may send messages and recommended actions to be taken at one or more locations relating to the water breakthrough and may automatically initiate or take one or more of the recommended actions.

Examples of the more important features of system and method for water breakthrough detection and intervention in a production well have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the system and methods for water breakthrough detection an intervention of wells described and claimed herein, reference should be made to the accompanying drawings and the following detailed description of the drawings wherein like elements generally have been given like numerals, and wherein:

DETAILED DESCRIPTION OF THE DRAWINGS

Figure 1A:
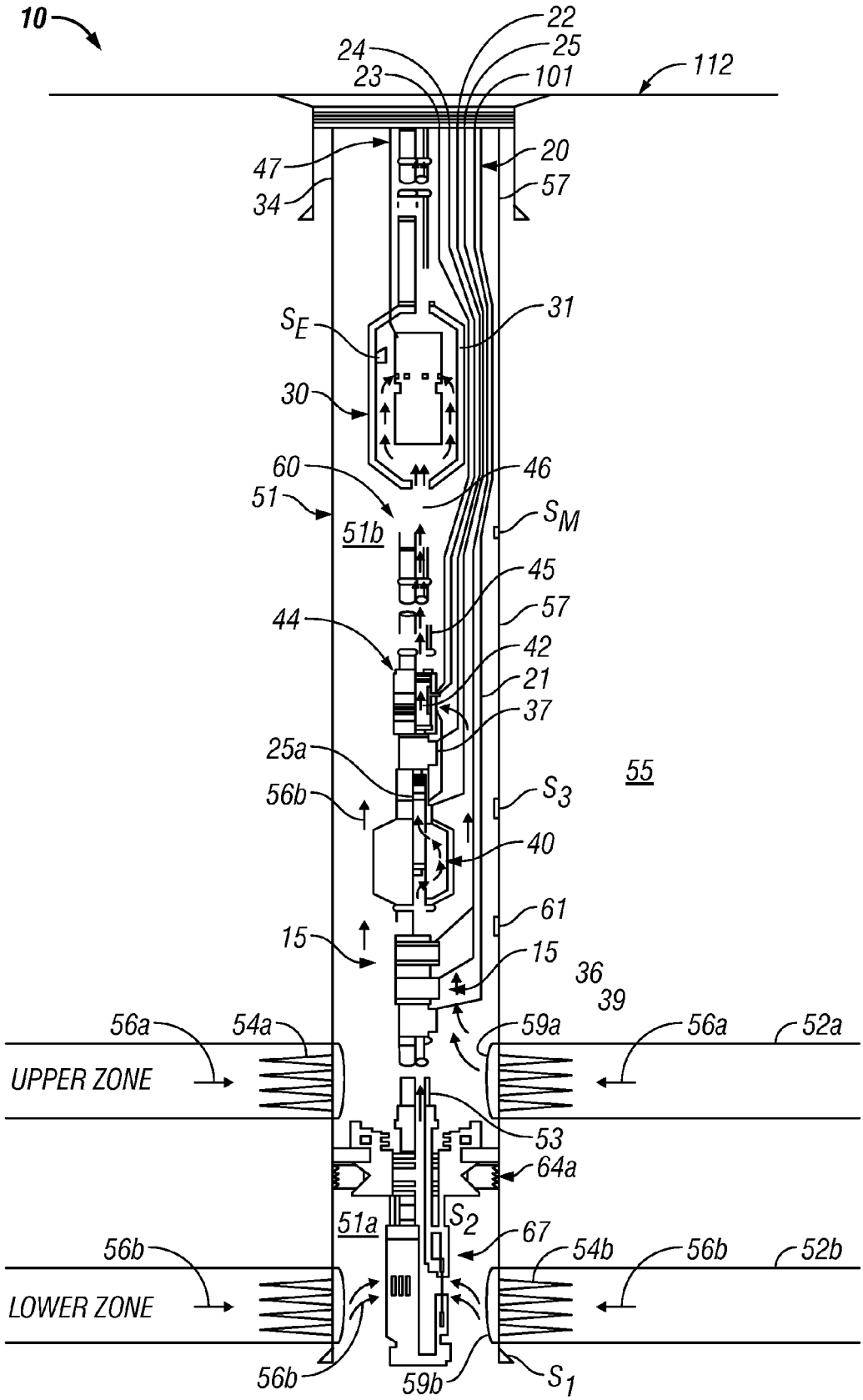
FIGS. 1A and 1B collectively show a schematic diagram of a production well system for producing fluid from multiple production zones according to one possible embodiment.
Figure 1B:
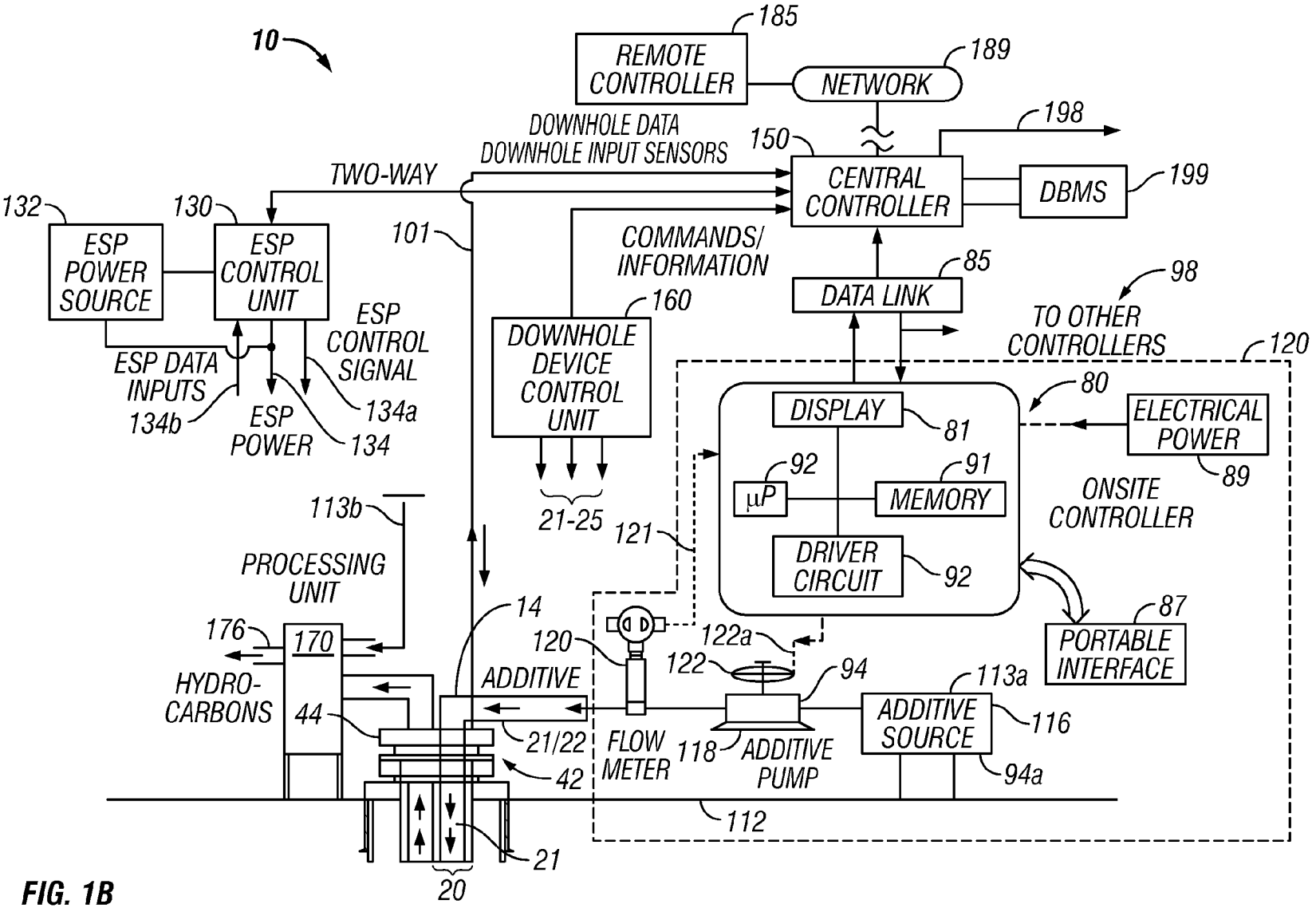

FIGS. 1A and 1B collectively show a schematic diagram of a production well system 10 that includes various flow control devices and sensors in the well 50 and at the surface 112, and further includes controllers, computer programs and algorithms that may be used collectively to implement the methods and concepts described herein. FIG. 1A shows a production well 50 that has been configured using exemplary equipment, devices and sensors that may be utilized to implement the concepts and methods described herein. FIG. 1B shows exemplary surface equipment, devices, sensors, controllers, computer programs, models and algorithms that may be utilized to: detect and/or predict an occurrence of a breakthrough condition in the well; send appropriate messages and alarms to an operator; determine adjustments to be made or actions to be taken relating to the various operations of the well 50 to mitigate or eliminate negative effects of the potential or actual occurrence of the water breakthrough; automatically control any one or more of the devices or equipment in the system 10; and establish a two-way communication with one or more remote locations and/or controllers via appropriate links, including the Internet, wired or wireless links.

FIG. 1A shows a well 50 formed in a formation 55 that is producing formation fluid 56*a* and 56*b* from two exemplary production zones 52*a* (upper production nzone) and 52*b* (lower production zone) respectively. The well 50 is shown lined with a casing 57 that has perforations 54*a* adjacent the upper production zone 52*a* and perforations 54*b* adjacent the lower production zone 52*b*. A packer 64, which may be a retrievable packer, positioned above or uphole of the lower production zone perforations 54*a* isolates the lower production zone 52*b* from the upper production zone 52*a*. A screen 59*b* adjacent the perforations 54*b* the well 50 may be installed to prevent or inhibit solids, such as sand, from entering into the wellbore from the lower production zone 54*b*. Similarly, a screen 59*a* may be used adjacent the upper production zone perforations 59*a* to prevent or inhibit solids from entering into the well 50 from the upper production zone 52*a*.

The formation fluid 56*b* from the lower production zone 52*b* enters the annulus 51*a* of the well 50 through the perforations 54*a* and into a tubing 53 via a flow control valve 67. The flow control valve 67 may be a remotely control sliding sleeve valve or any other suitable valve or choke that can regulate the flow of the fluid from the annulus 51*a* into the production tubing 53. An adjustable choke 40 in the tubing 53 may be used to regulate the fluid flow from the lower production zone 52*b* to the surface 112. The formation fluid 56*a* from the upper production zone 52*a* enters the annulus 51*b* (the annulus portion above the packer 64*a*) via perforations 54*a*. The formation fluid 56*a* enters production tubing or line 45 via inlets 42. An adjustable valve or choke 44 associated with the line 45 regulates the fluid flow into the line 45 and may be used to adjust flow of the fluid to the surface 112. Each valve, choke and other such device in the well may be operated electrically, hydraulically, mechanically and/or pneumatically from the surface. The fluid from the upper production zone 52*a* and the lower production zone 52*b* enter the line 46.

In cases where the formation pressure is not sufficient to push the fluid 56*a* and/or fluid 56*b* to the surface, an artificial lift mechanism, such as an electrical submersible pump (ESP, a gas lift system, a beam pump, a jet pump, a hydraulic pump or a progressive cavity pump) may be utilized to pump the fluids from the well to the surface 112. In the system 10, an ESP 30 in a manifold 31 receives the formation fluids 56*a* and 56*b* and pumps such fluids via tubing 47 to the surface 112. A cable 34 provides power to the ESP 30 from a surface power source 132 (FIG. 1B) that is controlled by an ESP control unit 130. The cable 134 also may include two-way data communication links 134*a* and 134*b*, which may include one or more electrical conductors or fiber optic links to provide a two-way signals and data link between the ESP 30, ESP sensors $S_E$ and the ESP control unit 130. The ESP control unit 130, in one aspect, controls the operation of the ESP 30. The ESP control unit 130 may be a computer-based system that may include a processor, such as a microprocessor, memory and programs useful for analyzing and controlling the operations of the ESP 30. In one aspect, the controller 130 receives signals from sensors $S_E$ (FIG. 1A) relating to the actual pump frequency, flow rate through the ESP, fluid pressure and temperature associated with the ESP 30 and may receive measurements or information relating to certain chemical properties, such as corrosion, scaling, asphaltenes, etc. and response thereto or other determinations control the operation of the ESP 30. In one aspect, the ESP control unit 130 may be configured to alter the ESP pump speed by sending control signals 134*a* in response to the data received via link 134*b* or instructions received from another controller. The ESP control unit 130 may also shut down power to the ESP via the power line 134. In another aspect, ESP control unit 130 may provide the ESP related data and information (frequency, temperature, pressure, chemical sensor information, etc.) to the central controller 150, which in turn may provide control or command signals to the ESP control unit 130 to effect selected operations of the ESP 30.

A variety of hydraulic, electrical and data communication lines (collectively designated by numeral 20 (FIG. 1A) are run inside the well 50 to operate the various devices in the well 50 and to obtain measurements and other data from the various sensors in the well 50. As an example, a tubing 21 may supply or inject a particular chemical from the surface into the fluid 56*b* via a mandrel 36. Similarly, a tubing 22 may supply or inject a particular chemical to the fluid 56*a* in the production tubing via a mandrel 37. Lines 23 and 24 may operate the chokes 40 and 42 and may be used to operate any other device, such as the valve 67. Line 25 may provide electrical power to certain devices downhole from a suitable surface power source.

In one aspect, a variety of other sensors are placed at suitable locations in the well 50 to provide measurements or information relating to a number of downhole parameters of interest. In one aspect, one or more gauge or sensor carriers, such as a carrier 15, may be placed in the production tubing to house any number of suitable sensors. The carrier 15 may include one or more temperature sensors, pressure sensors, flow measurement sensors, resistivity sensors, sensors that provide information about density, viscosity, water content or water cut, and chemical sensors that provide information about scale, corrosion, asphaltenes, hydrates etc. Density sensors may be fluid density measurements for fluid from each production zone and that of the combined fluid from two or more production zones. The resistivity sensor or another suitable sensor may provide measurements relating to the water content or the water cut of the fluid mixture received from each production zones. Other sensors may be used to estimate the oil/water ratio and gas/oil ratio for each production zone and for the combined fluid. The temperature, pressure and flow sensors provide measurements for the pressure, temperature and flow rate of the fluid in the line 53. Additional gauge carriers may be used to obtain pressure, temperature and flow measurements, water content relating to the formation fluid received from the upper production zone 52*a*. Additional downhole sensors may be used at other desired locations to provide measurements relating to chemical characteristics of the downhole fluid, such as paraffins, hydrates, sulfides, scale, asphaltene, emulsion, etc. Additionally, sensors $s_1$-$s_m$ may be permanently installed in the wellbore 50 to provide acoustic or seismic measurements, formation pressure and temperature measurements, resistivity measurements and measurements relating to the properties of the casing 51 and formation 55. Such sensors may be installed in the casing 57 or between the casing 57 and the formation 55. Additionally, the screen 59*a* and/or screen 59*b* may be coated with tracers that are released due to the presence of water, which tracers may be detected at the surface or downhole to determine or predict the occurrence of water breakthrough. Sensors also may be provided at the surface, such as a sensor for measuring the water content in the received fluid, total flow rate for the received fluid, fluid pressure at the wellhead, temperature, etc.

In general, sufficient sensors may be suitably placed in the well 50 to obtain measurements relating to each desired parameter of interest. Such sensors may include, but are not limited to, sensors for measuring pressures corresponding to each production zone, pressure along the wellbore, pressure inside the tubings carrying the formation fluid, pressure in the annulus, temperatures at selected places along the wellbore, fluid flow rates corresponding to each of the production zones, total flow rate, flow through the ESP, ESP temperature and pressure, chemical sensors, acoustic or seismic sensors, optical sensors, etc. The sensors may be of any suitable type, including electrical sensors, mechanical sensors, piezoelectric sensors, fiber optic sensors, optical sensors, etc. The signals from the downhole sensors may be partially or fully processed downhole (such as by a microprocessor and associated electronic circuitry that is in signal or data communication with the downhole sensors and devices) and then communicated to the surface controller 150 via a signal/data link, such as link 101. The signals from downhole sensors may be sent directly to the controller 150 as described in more detail herein.

Referring back to FIG. 1B, the system 10 is further shown to include a chemical injection unit 120 at the surface for supplying additives 113*a* into the well 50 and additives 113*b* to the surface fluid treatment unit 170. The desired additives 113*a* from a source 116*a* (such as a storage tank) thereof may be injected into the wellbore 50 via injection lines 21 and 22 by a suitable pump 118, such as a positive displacement pump. The additives 113*a* flow through the lines 21 and 22 and discharge into the manifolds 30 and 37. The same or different injection lines may be used to supply additives to different production zones. Separate injection lines, such as lines 21 and 22, allow independent injection of different additives at different well depths. In such a case, different additive sources and pumps are employed to store and to pump the desired additives. Additives may also be injected into a surface pipeline, such as line 176 or the surface treatment and processing facility such as unit 170.

A suitable flow meter 120, which may be a high-precision, low-flow, flow meter (such as gear-type meter or a nutating meter), measures the flow rate through lines 21 and 22, and provides signals representative of the corresponding flow rates. The pump 118 is operated by a suitable device 122, such as a motor or a compressed air device. The pump stroke and/or the pump speed may be controlled by the controller 80 via a driver circuit 92 and control line 122*a*. The controller 80 may control the pump 118 by utilizing programs stored in a memory 91 associated with the controller 80 and/or instructions provided to the controller 80 from the central controller or processor 150 or a remote controller 185. The central controller 150 communicates with the controller 80 via a suitable two-way link 85. The controller 80 may include a processor 92, resident memory 91, for storing programs, tables, data and models. The processor 92, utilizing signals from the flow measuring device received via line 121 and programs stored in the memory 91 determines the flow rate of each of the additives and displays such flow rates on the display 81. A sensor 94 may provide information about one or more parameters of the pump, such the pump speed, stroke length, etc. The pump speed or stroke, as the case may be, is increased when the measured amount of the additive injected is less than the desired amount and decreased when the injected amount is greater than the desired amount. The controller 80 also includes circuits and programs, generally designated by numeral 92 to provide interface with the onsite display 81 and to perform other desired functions. A level sensor 94*a* provides information about the remaining contents of the source 116. Alternatively, central controller 150 may send commands to controller 80 relating to the additive injection or may perform the functions of the controller 80. While FIGS. 1A-B illustrates one production well, it should be understood that an oil field can include a plurality of production wells and also variety of wells, such as offset wells, injection wells, test wells, etc. The tools and devices shown in the Figures can be utilized in any number of such wells and can be configured to work cooperatively or independently.

Figure 2:
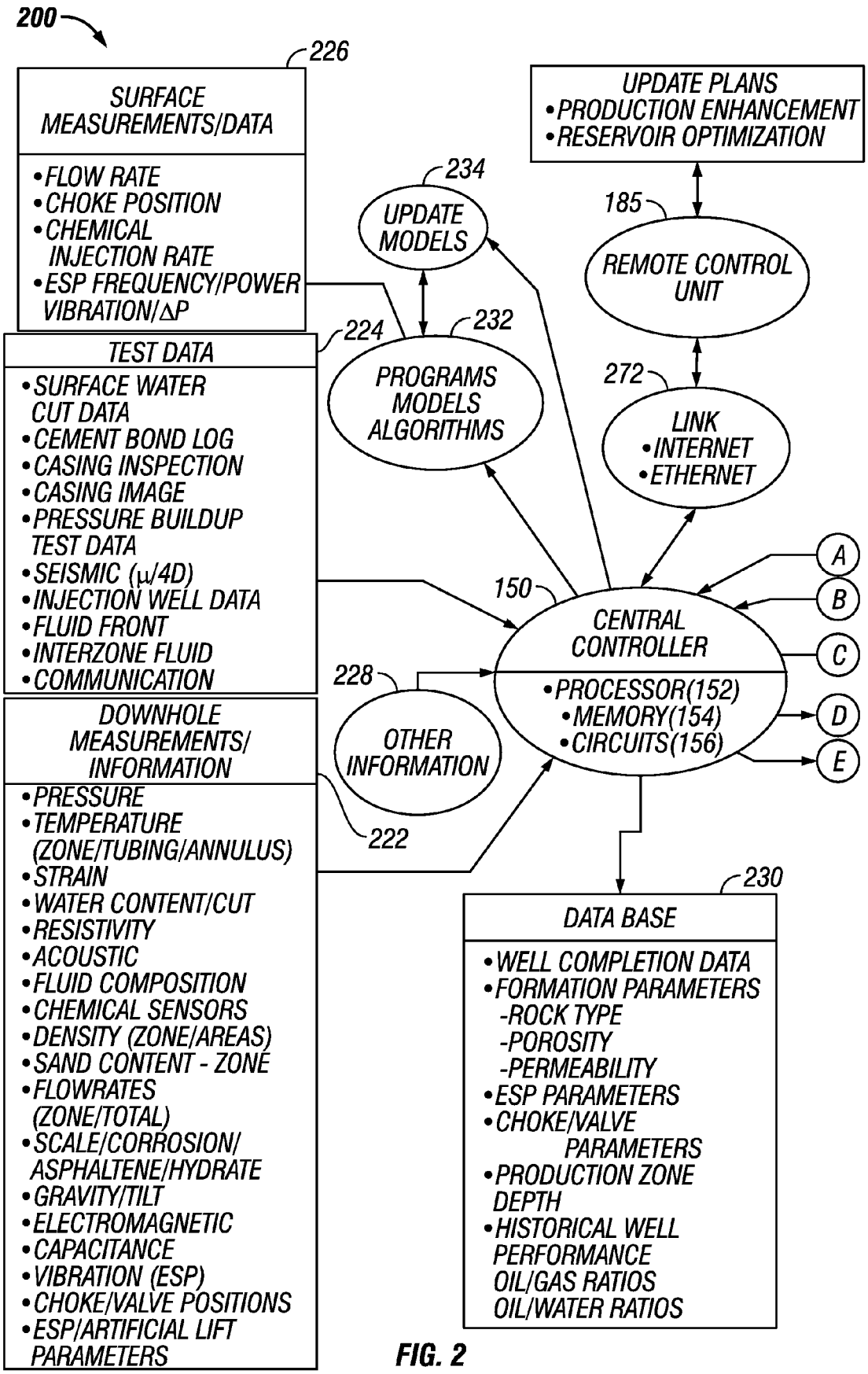
FIG. 2 is an exemplary functional diagram of a control system that may be utilized for a well system, including the system shown in FIGS. 1A and 1B, to take various measurements relating to the well, predict water breakthrough, determine desired actions that may be taken to mitigate the effects of such a water breakthrough on the well and take one or more such actions.
Figure 2:
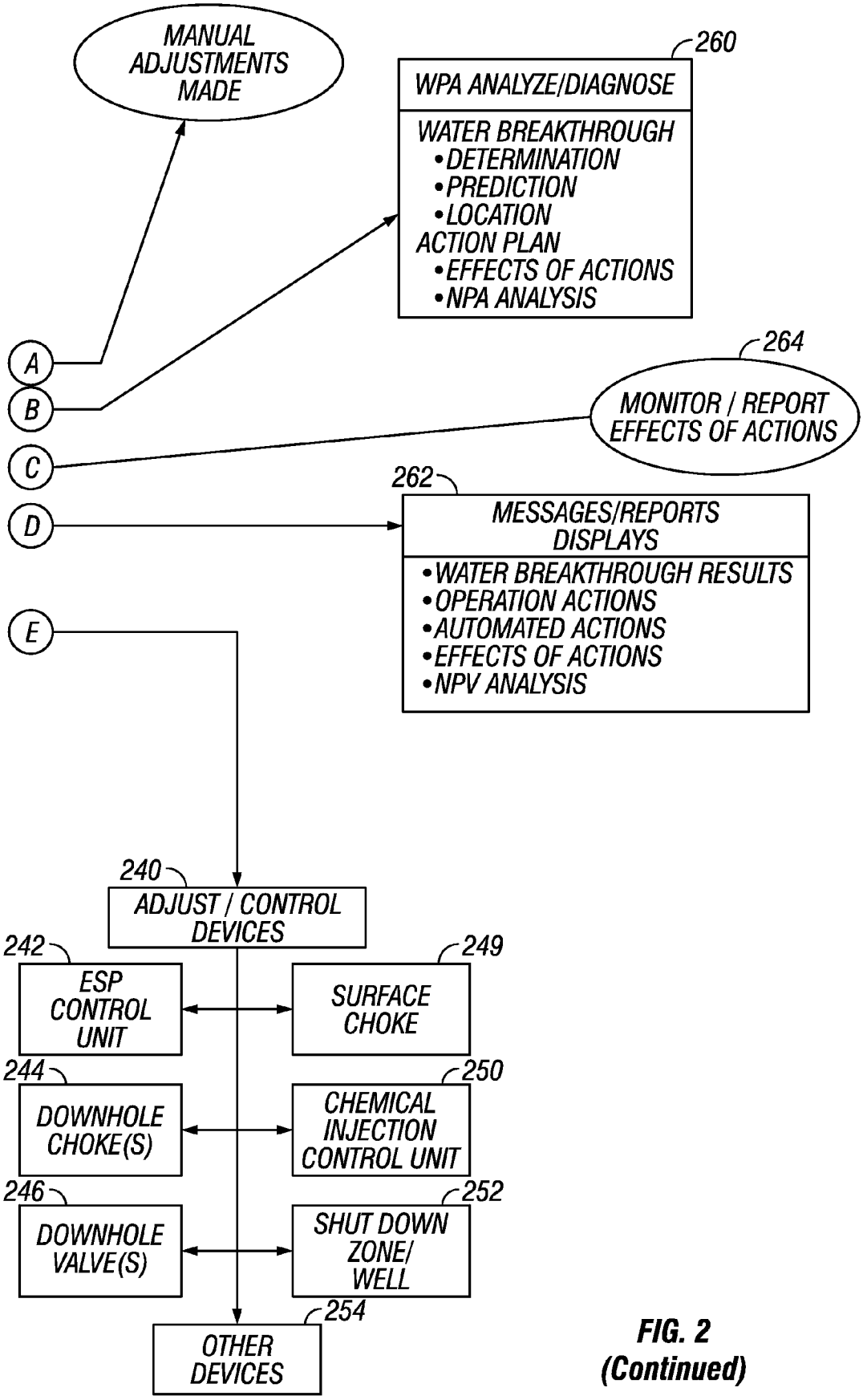

FIG. 2 shows a functional diagram of a production well system 200 that may be utilized to implement the various functions and method relating to detection and prediction of water breakthrough, determining actions that may be taken to mitigate the effects of an occurrence of a water breakthrough condition, for taking certain actions in response thereto and for performing other functions described herein for a production well system, including the well system 10 of FIGS. 1A and 1B. The operation of the well system 10 is described herein in reference to FIGS. 1A, 1B and 2.

Referring to FIG. 2, the system 200 includes a central control unit or controller 150 that includes a processor 152, memory 154 and associated circuitry 156 that may be utilized to perform various functions and methods described herein. The system 200 includes a database 230 that is accessible to the processors 152, which database may include well completion data and information, such as: types and locations of sensors in the well; sensor parameters; types of devices and their parameters, such as choke sizes, choke positions, valve sizes, valve positions, etc; formation parameters, such as rock type for various formation layers, porosity, permeability, mobility, depth of each layer and each production zone; sand screen parameters; tracer information; ESP parameters, such as horsepower, frequency range, operating pressure and temperature ranges; historical well performance data, including production rates over time for each production zone, pressure and temperature values over time for each production zone; current and prior choke and valve settings; remedial work information; water content corresponding each production zone over time; initial seismic data and updated seismic data (four D seismic data), waterfront monitoring data. etc.

During the life of a well, one or more tests, collectively designated by numeral 224, are typically performed to estimate the health of various well elements and various parameters of the formations surrounding the well, including the production zones. Such tests may include, but are not limited to: casing inspection tests using electrical or acoustic logs;

well shut-in tests that may include pressure build-up, temperature and flow tests; seismic tests that may use a source at the surface and seismic sensors in the well to determine water front and bed boundary conditions; fluid front monitoring tests; secondary recovery tests, etc. All such test data 224 may be stored in a memory and provided to the processor 152 for estimating one or more aspect relating to the water breakthrough. Additionally, the processor 152 of system 200 may have periodic or continuous access to the downhole sensor measurement data 222 and surface measurement data 226 and any other desired information or measurements 228. The downhole sensor measurement data 222 includes, but is not limited to information relating to water content, resistivity, density, sand content, flow rates, pressure, temperature, chemical characteristics or compositions, density, gravity, inclination, electrical and electromagnetic measurements, and choke and valve positions. The surface measurements 226 include, but are not limited to, flow rates, pressure, choke and valve positions, ESP parameters, water content calculations, chemical injection rates and locations, tracer detection information, etc.

The system 200 also includes programs, models and algorithms 232 embedded in one or more computer-readable media that are accessible to the processor 152 to execute instructions contained in the programs to perform the methods and functions described herein. The processor 152 may utilize one or more programs, models and algorithms to perform the various functions and methods described herein. In one aspect, the programs/models/algorithms 232 may include a well performance analyzer 260 that uses a nodal analysis, neural network or another algorithm to detect and/or predict water breakthrough, estimate the source or sources of the water breakthrough, such as the location of zones and formations above and/or below the production zones, cracks in cement bonds or casing, etc., the extent or severity of the water breakthrough and an expected time or time period in which a water breakthrough may occur.

In operation, the central controller 150 receives downhole measurements and/or information relating to downhole measurements (collectively designated by numeral 222). The central controller 150 may be programmed to receive some or all such information periodically or continuously. In one aspect, the central controller 150 may estimate a measure of water (such as water content, water cut, etc.) relating to the formation fluid (for each zone and/or of the combined flow) over a time period and estimate or predict an occurrence of the water breakthrough using such water measure estimates. The controller 150 may utilize a trend associated with the water measures over a time period or utilize real-time or near real-time estimates of the water measures to detect and/or predict the occurrence of the water breakthrough. The measure of water in the formation fluid may be provided by an analyzer at the surface that determines the water content or water cut in the produced fluid 224. A water measure may include, but is not limited to, a quantity, a percentage of water cut, a threshold value, a magnitude of change in values, etc. The water measure or water content in the formation fluid may also be estimated from: the downhole sensors (such as resistivity or density sensors); analysis of tracers present in the produced fluid downhole or at the surface; density measurements; or from any other suitable sensor measurements. The water content may also be calculated in whole or in part downhole by a suitable processor and transmitted to the central controller 150 via a suitable link or wireless telemetry method, including acoustic and electromagnetic telemetry methods. The central controller 150, in one aspect, may utilize one or more programs, models and/or algorithms to estimate whether the water breakthrough already has occurred or when the water breakthrough may occur, i.e., predict the occurrence of a water breakthrough. The models/algorithms may use information relating to the formation parameters 230; well completion data 230; test data 224 on the well 50; and other information to predict the occurrence of the water breakthrough and/or the source of such breakthrough. For example, the processor may predict an occurrence of a water breakthrough using four dimensional seismic maps in view of the position of the water front relating to a particular producing zone or from formation fractures associated with the producing zone. Four dimensional seismic maps can, for example, visually illustrate changes in subsurface formations over a selected time period. The processor 152 may also predict the location of the water breakthrough in view of such data. In another aspect, the processor may predict water breakthrough due to the deterioration of the casing from the casing inspection data or the deterioration in the cement bonds. In any case, the processor may utilize the current and prior information.

Once the central controller 150 using the well performance analyzer determines an actual or potential water breakthrough, it determines the actions to be taken to mitigate or eliminate the effects of the water breakthrough and may send messages, alarm conditions, water breakthrough parameters, the actions for the operator to take, the actions that are automatically taken by the controller 150 etc. as shown at 260, which messages are displayed at a suitable display 262 located at one or more locations, including at the well site and/or a remote control unit 185. The information may be transmitted by any suitable data link, including an Ethernet connection and the Internet. 272. The information sent by the central controller may be displayed at any suitable medium, such as a monitor. The remote locations may include client locations or personnel managing the well from a remote office. The central controller 150 utilizing data, such as current choke positions, ESP frequency, downhole choke and valve positions, chemical, injection unit operation and any other information 226 may determine one or more adjustments to be made or actions to be taken (collectively referred to operation(s)) relating to the operation of the well, which operations when implemented are expected to mitigate or eliminate certain negative effects of the actual or potential water breakthrough on the well 50. The central controller 150 may recommend closing a particular production zone by closing a valve or choke; closing all zones; closing a choke at the surface; reducing fluid production from a particular zone; altering frequency of the ESP or shutting down the ESP; altering chemical injection to a zone etc. The central controller 150 sends these recommendations to an operator. The well performance analyzer, in aspect, may use a forward looking model, which may use a nodal analysis, neural network or another algorithm to estimate or assess the effects of the suggested actions and to perform an economic analysis, such as a net present value analysis based on the estimated effectiveness of the actions. The well performance analyzer also may estimate the cost of initiating any one or more of the actions and may perform a comparative analysis of different or alternative actions. The well performance analyzer also may use an iterative process to arrive at an optimal set of actions to be taken by the operator and/or the controller 150. The central controller may continually monitor the well performance and the effects of the actions 264 and sends the results to the operator and the remote locations.

In one aspect, the central controller 150 may be configured to wait for a period of time for the operator to take the suggested actions (manual adjustments 265) and in response to the adjustments made by the operator recompute the water breakthrough information, any additional desired actions and continue to operate in the manner described above.

In another aspect, the central controller may be configured to automatically initiate one or more of the recommended actions, for example, by sending command signals to the selected device controllers, such as to ESP controller to adjust the operation of the ESP 242; control units or actuators (160, FIG. 1A and element 240) that control downhole chokes 244, downhole valves 246; surface chokes 249, chemical injection control unit 250; other devices 254, etc. Such actions may be taken in real time or near real time. The central controller 150 continues to monitor the effects of the actions taken 264. In another aspect, the central controller 150 or the remote controller 185 may be configured to update one or more models/algorithms/programs 234 for further use in the monitoring of the well. Thus, the system 200 may operate in a closed-loop form to continually monitor the performance of the well, detect and/or predict water breakthrough, determine actions that will mitigate negative effects of the water breakthrough, determine the effects of any action taken by the operator, automatically initiate actions, perform economic analysis so as to enhance or optimize production from one or more zones.

Still referring to FIGS. 1A, 1B and 2, in general, methods for detecting and/or predicting a water breakthrough in a producing well are disclosed. One method includes estimating a measure of water in the fluid produced from the at least one production zone at least periodically, and predicting the occurrence of the water breakthrough utilizing at least in part a trend of the estimated measures of the water. The estimated measures may be obtained from any one or more of: (i) a measurement of water content or water cut of the fluid received at the surface; (ii) a measurement obtained from a sensor in the well; (iii) a density of the produced fluid; (iv) a resistivity measurement of the produced fluid; and (v) measurements of a parameter of interest made at a number of locations in the well; (vi) a measurement relating to release of a tracer placed in the well; (vii) an optical sensor measurement in the well; and (viii) acoustic measurements in the well. Estimating the occurrence of the water breakthrough may include comparing the trend with a predetermined anticipated trend. The method may further include determining a physical condition of one or more of: (i) a casing in the well; (ii) a cement bond between the casing and a formation; (iii) formation boundary conditions; and utilizing one or more of the determined physical conditions to estimate a location of water penetrating at least one the production zones.

In another aspect, a method may predict the occurrence of the water breakthrough from test data, such as seismic data, fluid front data, casing or cement bond log data, etc. Such a method may not necessarily rely on an analysis of a produced fluid. Rather, in aspects, the method may predict an occurrence of the water breakthrough based on factors such as proximity of a water front to a well, a rate of movement of a water front, changes in pressure, etc. Based on measurements indicative of such factors, the method can predict or estimate the occurrence of the water breakthrough. In another aspect, the method may updates any one or more of programs, models and algorithms based on the water breakthrough information and/or the actions taken in response thereto.

The method may further include predicting a time or a time period of the occurrence of the water breakthrough. The method may further include performing one or more operation relating to the well in response to estimation of the occurrence of the water breakthrough. The operations may be one or more of: (i) closing a choke; (ii) changing operation of an electrical submersible pump installed in the well; (iii) operating a valve in the well; (iv) changing an amount of an additive supplied to the well; (v) closing fluid flow from a selected production zone; (vi) isolating fluid flow from a production zone; (vii) performing a secondary operation to reduce probability of the estimated occurrence of the water breakthrough; (viii) sending a message to an operator informing about the estimated occurrence of the water breakthrough; and (ix) sending a suggested operation to be performed by an operator. The estimation of the occurrence of the water breakthrough may be done substantially in real time.

In another aspect, one or more computer programs may be provided on a computer-readable-medium that is accessed by a processor for executing instructions contained in the one or more computer programs to perform the methods and functions described herein. In one aspect, the computer program may include (a) instructions to at least periodically compute a measure of water in the fluid produced by the at least one production zone; and (b) instructions to predict an occurrence of the water breakthrough utilizing at least in part a trend of the measures of water. The computer program may further include instructions to estimate the occurrence of the water breakthrough using at least one of: (i) the amount of water in the produced fluid received at the surface; (ii) a measurement obtained from a sensor in the well; (iii) a density of the produced fluid; (iv) a resistivity measurement of the produced fluid; (v) measurements of a parameter of interest made at a plurality of locations in the well; (vi) a release of a tracer placed in the well; (vii) an optical sensor measurement in the well; and (viii) acoustic measurements in the well. The instructions to estimate the occurrence of the water breakthrough may further include instructions to compare the trend with a predetermined trend and provide the estimate of the occurrence of the water breakthrough when the difference between the trend and the predetermined trend cross a threshold. The computer program may further include instructions to send a signal to perform an operation that is selected from a group consisting of: (i) closing a choke; (ii) changing operation of an electrical submersible pump installed in the well; (iii) operating a valve in the well; (iv) changing an amount of an additive supplied to the well; (v) closing fluid flow from a selected production zone; (vi) isolating fluid flow from a production zone; (vii) a performing a secondary operation to reduce probability of an occurrence of the water breakthrough; (viii) sending a message to an operator informing about the estimated occurrence of the water breakthrough; and (ix) sending a suggested operation to be performed by an operator.

In another aspect, a system is disclosed that detects the occurrence of the water breakthrough in a well that is producing formation fluid from one or more production zones. The system includes a well that has one or more flow control devices that control the flow of the formation fluid into the well. The system also may include one or more sensors for providing measurements that are indicative of a measure of water in the formation fluids. A controller at the surface utilizing information from the sensors and/or other information and/or test data estimates the occurrence of the water breakthrough. In one aspect a processor associated with the controller: (i) estimates an amount of water in the fluid produced from the at least one production zone at least periodically; and (ii) estimates the occurrence of the water breakthrough utilizing at least in part a trend of the estimated amounts of water. The processor also may determine one or more actions that may be taken to mitigate an effect of the water breakthrough and may initiate one or more such actions by adjusting at least one flow control device in the system.

While the foregoing disclosure is directed to the preferred embodiments of the invention, various modifications will be apparent to those skilled in the art. It is intended that all variations within the scope of the appended claims be embraced by the foregoing disclosure. Also, the abstract is provided to meet certain statutory requirements and is not to be construed in any way to limit the scope of this disclosure or the claims.

What is claimed is:

1. A method of predicting an occurrence of a water breakthrough in a well that is producing a fluid from at least one production zone, comprising:

producing a formation fluid from one or more production zones;

measuring, using one or more sensors, water content or water cut in the produced fluid received from the one or more production zones periodically;

determining a trend of the water content or water cut from the water content or water cut measurements over a time period;

providing porosity and permeability of the production zone;

providing a parameter of the wellbore;

providing a simulation model; and predicting, using a processor, the water breakthrough utilizing the simulation model, the parameter of the wellbore, the trend of the water content or water cut and one of the porosity and permeability of the one or more production zones.

2. The method of claim 1, wherein measuring water content or water cut comprises using at least one of: (i) a measurement of water content in the fluid received at the surface; (ii) a measurement obtained from a sensor in the well; (iii) a density of the produced fluid; (iv) a resistivity measurement of the produced fluid; (v) measurements of a parameter of interest made at a plurality of locations in the well; (vi) a release of a tracer placed in the well; (vii) an optical sensor measurement in the well; and (viii) acoustic measurements in the well.

3. The method of claim 1, wherein predicting the water breakthrough comprises comparing the trend with a predetermined anticipated trend.

4. The method of claim 1, further comprising determining a physical condition of one of: (i) a casing in the well and, (ii) a cement bond between the casing and a formation, and correlating the determined physical condition with a predetermined physical condition to estimate a location of the predicted water breakthrough.

5. The method of claim 1, further comprising using an acoustic measurement in the well to confirm the prediction of the occurrence of the water breakthrough.

6. The method of claim 1, further comprising predicting a time of an occurrence of the water breakthrough.

7. The method of claim 6, further comprising performing at least one operation relating to the well in response to the predicting of the time of the occurrence of the water breakthrough.

8. The method of claim 7, wherein the at least one operation is selected from a group consisting of: (i) closing a choke; (ii) changing operation of an electrical submersible pump installed in the well; (iii) operating a valve in the well; (iv) changing an amount of an additive supplied to the well; (v) closing fluid flow from a selected production zone; (vi) isolating fluid flow from a production zone; (vii) performing a secondary operation to reduce probability of the estimated occurrence of the water breakthrough; (viii) sending a message to an operator informing about the estimated occurrence of the water breakthrough; and (ix) sending a suggested operation to be performed by an operator.

9. The method of claim 1, wherein predicting the water breakthrough is accomplished substantially in real time.

10. The method of claim 1, further comprising logging the well to estimate a location of the water breakthrough.

11. The method of claim 10, wherein the logging of the well is one of: (i) logging to determine a condition of a cement bond between a casing in the well and a formation surrounding the well; and (ii) logging to determine one or more defects in the casing in the well.

12. The method of claim 1, wherein the one or more production zone includes a plurality of production zones and wherein the method further comprises predicting the water breakthrough corresponding to a particular zone in the plurality of production zones.

13. A computer-readable medium accessible to a processor for executing instructions contained in a computer program embedded in the computer-readable medium, the computer program comprising:

instructions to at least periodically compute a measure of water content or water cut in a fluid produced by one or more production zones of a well;

instructions to define a model that utilizes at least one parameter of the wellbore and at least one of a permeability and porosity of the well;

instructions to determine a trend of the measure of water from the periodically computed measure of water content or water cut; and instructions to predict in real-time when a water breakthrough will occur utilizing at least in part the trend of the measure of water and the model.

14. The computer-readable medium of claim 13, wherein the computer program further comprises instructions to estimate the occurrence of the water breakthrough using at least one of: (i) a measure of water in the produced fluid received at the surface; (ii) a measurement obtained from a sensor in the well;

(iii) a density of the produced fluid; (iv) a resistivity measurement of the produced fluid; (v) measurements of a parameter of interest made at a plurality of locations in the well; (vi) a release of a tracer placed in the well; (vii) an optical sensor measurement in the well; and (viii) acoustic measurements in the well.

15. The computer-readable medium of claim 13, wherein the instructions to predict the occurrence of the water breakthrough further comprises instructions to compare the trend with a predetermined trend to provide the prediction of the occurrence of the water breakthrough when the difference between the trend and a predetermined trend crosses a threshold.

16. The computer-readable medium of claim 13, wherein the computer program further comprises instructions to send a signal to perform an operation that is selected from a group consisting of: (i) closing a choke; (ii) changing operation of an electrical submersible pump installed in the well; (iii) operating a valve in the well; (iv) changing an amount of an additive supplied to the well; (v) closing fluid flow from a selected production zone; (vi) isolating fluid flow from a production zone; (vii) performing a secondary operation to reduce probability of an occurrence of the water breakthrough; (viii) sending a message to an operator informing about the estimated occurrence of the water breakthrough; and (ix) sending a suggested operation to be performed by an operator.

17. An apparatus for predicting an occurrence of a water breakthrough in a well that is producing fluid from at least one production zone, comprising:

a processor configured to:

measure water content or water cut in the produced fluid received from the one or more production zones periodically;

determine a trend of the water content or water cut from the water content or water cut measurements over a time period;

provide porosity and permeability of the production zone;

provide a parameter of the wellbore;

provide a simulation model; and predict the water breakthrough utilizing the simulation model, the parameter of the wellbore, the trend of the water content or water cut and one of the porosity and permeability of the one or more production zones.

18. The apparatus of claim 17, wherein the processor is further configured to control least one device at the well to control an effect of the estimated occurrence of the water breakthrough, which device is selected from a group consisting of: (i) a choke; (ii) an electrical submersible pump installed in the well; (iii) a valve in the well; (iv) an injection device supplying an additive to the well; (v) a flow control device closing fluid flow from a selected production zone; (vi) a flow isolation device isolating fluid flow from a production zone; (vii) a downhole tool configured to reduce a probability of an occurrence of the water breakthrough; and (viii) a transmitter sending a message to an operator relating to performing an operation relating to the well.

19. The apparatus of claim 17 further comprising a remote controller in data communication with the processor, wherein the processor is further configured to send information to the remote controller relating to the occurrence of the water breakthrough and wherein the remote controller is configured to send commands to the processor to control at least one device at the well.

20. The apparatus of claim 17, wherein the processor is further configured to compare the trend with a predetermined trend to predict the occurrence of the water breakthrough.

21. The apparatus of claim 17, wherein the processor is further configured to execute instructions contained in a computer program containing an algorithm for predicting a time of the occurrence of the water breakthrough.

* * * * *